US006860480B2

(12) United States Patent
Saltsov et al.

(10) Patent No.: US 6,860,480 B2
(45) Date of Patent: Mar. 1, 2005

(54) BANKNOTE DRIVE ROLLERS WITH ANTIJAMMING CHARACTERISTICS

(75) Inventors: Leon Saltsov, Thornhill (CA); Sergiy Bukhman, Toronto (CA)

(73) Assignee: Cashcode Company Inc., Concord ( * ) Notice: Subject to any disclaimer, the term of this patent is extended or adjusted under 35 U.S.C. 154(b) by 119 days.

(21) Appl. No.: 10/399,283

(22) PCT Filed: Oct. 17, 2001

(86) PCT No.: PCT/CA01/01447

§ 371 (c)(1),
(2), (4) Date: Apr. 16, 2003

(87) PCT Pub. No.: WO02/33666

PCT Pub. Date: Apr. 25, 2002

(65) Prior Publication Data

US 2004/0012142 A1 Jan. 22, 2004

(51) Int. Cl.[7] ..... B65H 5/22; B65H 83/00; B65H 85/00

(52) U.S. Cl. ..... 271/3.14

(58) Field of Search ..... 271/3.14, 184

(56) References Cited

U.S. PATENT DOCUMENTS

| | | | | | |
|---|---|---|---|---|---|
| 3,153,483 | A | | 10/1964 | Simjian | |
| 4,213,602 | A | | 7/1980 | Kuiji | |
| 4,474,365 | A | * | 10/1984 | DiBlasio | 271/3.2 |
| 5,207,788 | A | | 5/1993 | Geib et al. | |
| 5,806,650 | A | | 9/1998 | Mennie et al. | |
| 6,089,560 | A | * | 7/2000 | Fujiwara | 271/4.1 |

* cited by examiner

*Primary Examiner*—Donald P. Walsh
*Assistant Examiner*—Kenneth W Bower

(57) ABSTRACT

A banknote drive arrangement comprises a series of drive rollers which allow initial pivotting of a banknote during insertion of a banknote into a validator and also provide positive drive of a banknote out of the validator if the banknote is refused. The banknote drive arrangement includes at least two drive rollers which are always active and cooperate with respective passive rollers which are notched. The passive rollers lock against rotation in an infeed direction and freely rotate during ejection of a banknote.

10 Claims, 7 Drawing Sheets

BANKNOTE DRIVE ROLLERS WITH ANTIJAMMING CHARACTERISTICS

BACKGROUND OF THE INVENTION

The present invention relates to a drive system for driving a banknote into a validator and also allowing the banknote to be driven out of the validator in the reverse direction. In particular, some of the drive rollers have different operating characteristics with respect to the direction the banknote is being fed, and in particular, the rollers are active during ejection of a banknote to reduce possible jamming of the banknote.

Banknote validators are now commonly used with a host of different types of vending machines and gaming machines. These validators receive banknotes of different denominations and carry out certain investigations of the banknote to predict whether the banknote is authentic. The banknotes are typically received through an inlet of the validator and passed by a series of drive rollers past various sensors provided either side of a banknote evaluation channel. Investigations are conducted as the banknote is moved through the validator. If the investigations are satisfactory, the banknote is accepted and passed to a banknote cassette or banknote accumulator. If the investigations indicate the bill may not be authentic, it is rejected and returned to the user through the inlet.

Typically, the trailing edge of the banknote has passed the inlet to the validator before the final determination with respect to authenticity, is made and there can be problems if the banknote becomes jammed, upon a reverse direction of the drive rollers to return the banknote through the inlet. This results in a very unfortunate situation where the user has in good faith, provided the banknote to the validator and the validator has determined that the banknote should not be accepted. The attempt to return the unwanted banknote to the user results in the banknote becoming jammed within the validator. In many cases, the user does not even have a portion of the banknote exposed within the inlet which could be engaged to attempt to manually withdraw the banknote from the validator. Furthermore, the validator is now inoperative until a technician can access the validator and remove the jammed banknote.

The present invention provides a series of drive rollers having differing characteristics with respect to movement of the banknote in the feed direction, versus movement of the banknote to eject the banknote from the validator. In the forward direction, passive rollers are held against rotation while freely rotating in the opposite direction.

SUMMARY OF THE INVENTION

A banknote drive system for driving a banknote in one of two directions comprises a banknote inlet for receiving a leading edge of a banknote and guiding a banknote to a series of drive rollers located in a banknote guide channel. The series of banknote rollers is divided between active rollers which drive a banknote in a feed direction and a reject direction and one way direction active rollers which drive a banknote in the reject direction.

Each of the drive rollers have an associated passive roller positioned such that a banknote driven by the banknote drive system passes between each drive roller and the respective passive roller. Each one way active roller cooperates with the respective passive roller which is locked against rotation against movement of the banknote in a feed direction and which is driven during movement of a banknote in the reject direction.

BRIEF DESCRIPTION OF THE DRAWINGS

Preferred embodiments of the invention are shown in the drawings wherein.

DETAILED DESCRIPTION OF THE PREFERRED EMBODIMENT

Figure 2:
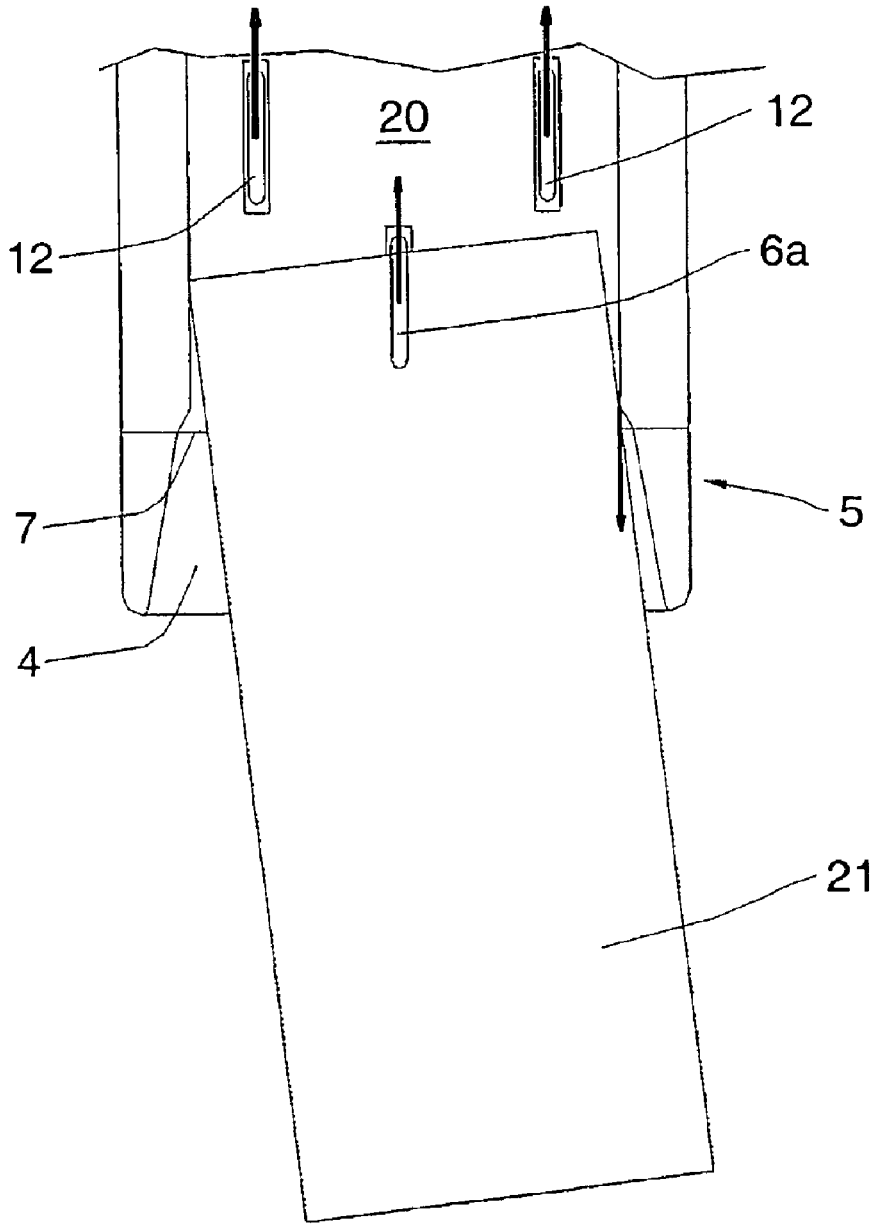
Fig. 2 (Prior art)
FIG. 2 is a schematic representation of a banknote drive arrangement used in validators for feeding of a prior art banknote into a validator.
Figure 3:
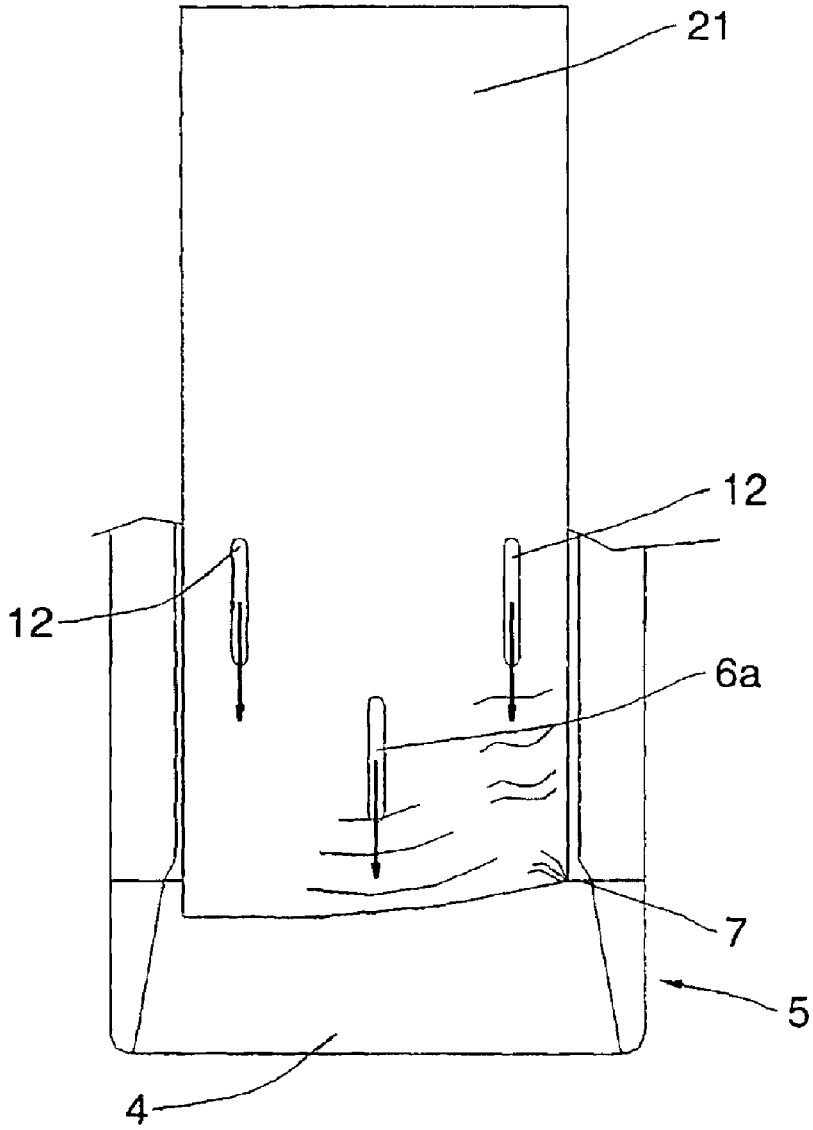
Fig. 3 (Prior art)
FIG. 3 is a schematic representation of the prior art arrangement of FIG. 2 showing a jammed banknote during ejection thereof through the inlet of a validator.

The drive roller arrangement for moving a banknote through the validator as shown in FIGS. 2 and 3, can, on occasion, lead to a jammed banknote during ejection of a refused banknote. This drive arrangement includes an initial drive roller located near the mouth of the inlet and two rearward drive rollers which engage the banknote and continue to move the banknote after the initial roller has caused the banknote to engage the rearward drive rollers. The single forward drive roller helps to correct for misalignment of the banknote as a banknote engages the channel forming a drag force causing a clockwise pivotting of the banknote. This ability to pivot continues until the banknote is engaged by the secondary drive rollers.

This desirable characteristic with respect to the feeding of a banknote through the validator, contributes to problems with respect to jamming of the banknote during ejection of the banknote. As described above, there can be misalignment of the banknote within the validator and some angling of the banknote as shown in FIG. 3, during ejection of the banknote, can cause jamming of the banknote at the inlet.

Figure 1:
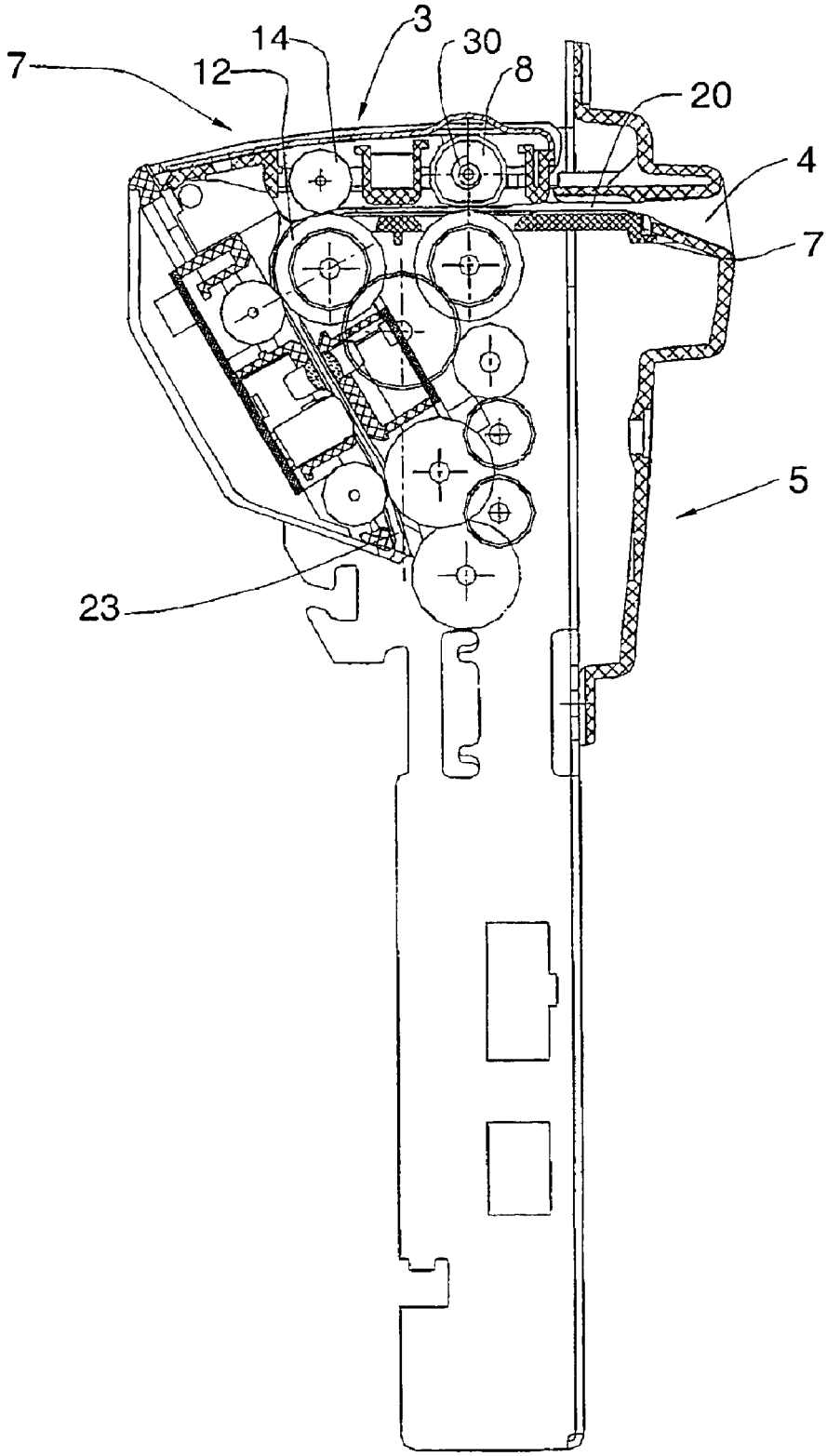
FIG. 1 is a vertical section view of a validator showing the drive arrangement.

The validator 2 of FIG. 1 includes an inlet 4 for receiving a banknote and guiding a banknote to the banknote evaluation channel 20. A banknote 21 (shown in FIGS. 2 through 5) passes through the inlet 4 with the leading edge of the banknote 21 exiting the validating head at position 23. A banknote drive system 3 is defined by leading drive rollers 6 and trailing drive rollers 12. Each of these drive rollers have an associated passive roller. In the case of leading outside drive wheels 6, each drive wheel 6 has a passive one way notched roller 8 whereas drive rollers 12 each have a passive cylindrical roller 14. The passive roller 8 has a particular shape and has an associated one way lock which will be described in subsequent Figures.

The validator 2 conducts a number of tests by means of sensors placed either side of the banknote channel 20 and either accepts or rejects the banknote. An accepted banknote passes out of the validating head at position 23 and is received by a banknote cassette or possibly by a banknote accumulator. If the banknote is rejected, the drive system 3 is reversed and the banknote is returned to the user through the inlet 4. Unfortunately, in prior art systems, this ejection of the banknote through the inlet 4 can result in a jammed banknote (FIG. 3) which often cannot be retrieved by the user and renders the validator inoperative until it is appropriately serviced by a technician.

Typically the front face of the validator includes an injection molded bezel 5 which defines the inlet 4 and also provides a smooth transition banknote channel 20 of the validator. The mating of the bezel with the entrance to the banknote channel can result in an interruption 7 or edge which can jam a banknote during the rejection of the banknote from the validator. Jamming can also occur due to misalignment alone.

FIG. 2 shows a prior art drive arrangement comprising three drive rollers, namely; a lead drive roller 6*a* and two secondary drive rollers 12. Each of these drive rollers includes a passive cylindrical roller 14 which forms a pinch engagement such that a banknote can pass between the drive roller 6*a* or 12 and its associated passive roller, and urge the banknote through the validator. Typically the passive rollers are spring biased to accommodate the thickness of the banknote.

In other cases, the rollers are deformable to accommodate the thickness of the banknote as it is driven between the rollers.

The triangular layout of the drive and passive rollers shown in FIG. 2 is desirable in that the lead roller 6*a* allows some pivotting of the banknote 3 to allow straightening of the banknote as it moves down the evaluation channel 20. It can be seen that the inlet 4 provides an inwardly tapering or guiding of the banknote to the banknote channel 20. This arrangement works extremely well for feeding of a banknote into the evaluation channel 20 and straightening of the banknote as it moves forward and prior to the banknote striking the secondary drive rollers 12.

Some problems can occur as illustrated in FIG. 3 during ejection of the banknote. In this case, the leading edge of the banknote has passed the junction 7 between the bezel 5 and the leading edge of the banknote evaluation channel 20 and upon return of the banknote to eject the banknote, some misalignment of the banknote can occur. This can result in one corner of the banknote becoming jammed within the validator.

Unfortunately, the banknote is still within the validator and the banknote is not exposed in the inlet to allow the user to pull the banknote from the validator. The jammed banknote renders the validator inoperative until authorized personnel can correct the situation. Correction typically requires opening of the validator and removing of the jammed banknote. It can be appreciated that the desirable features of the drive arrangement for feeding of the banknote into a validator has caused difficulties during ejection of the banknote from the validator.

Figure 4:
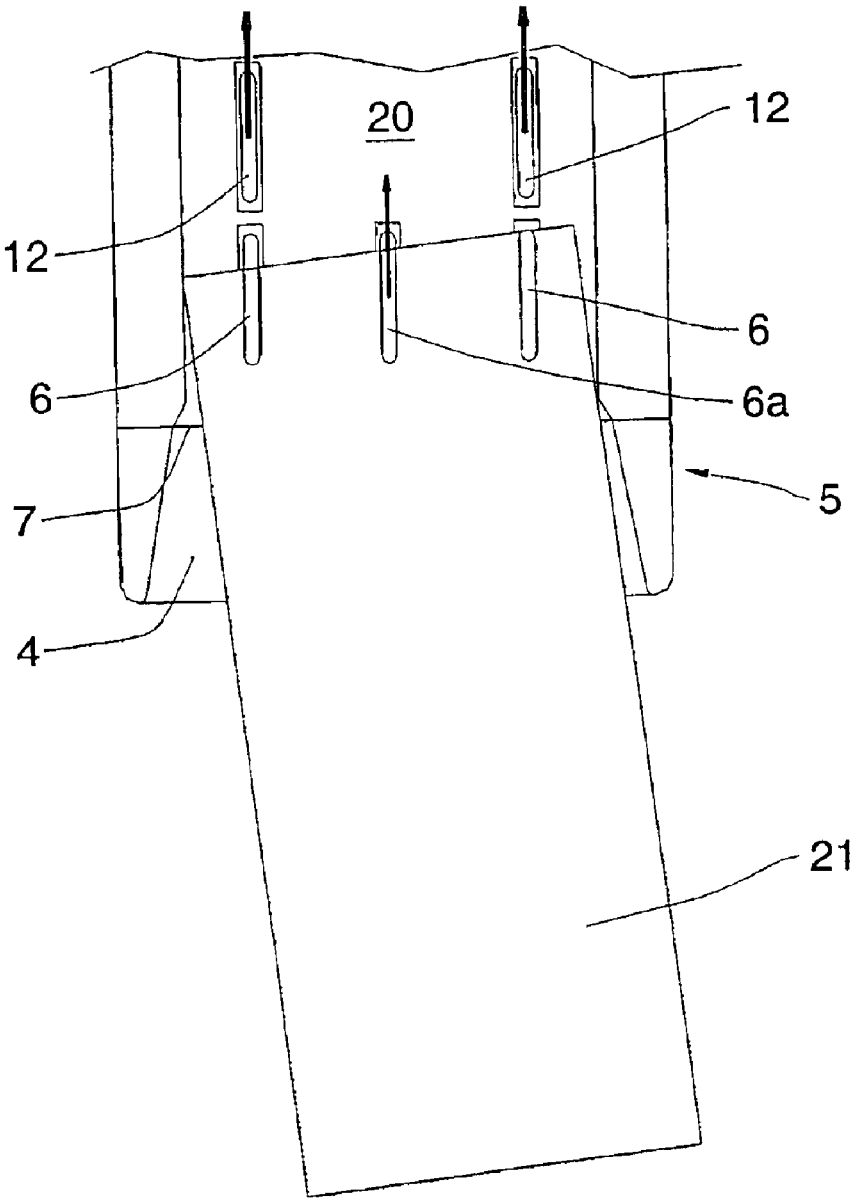
FIG. 4 illustrates the banknote drive system driven for feeding a banknote into the validator.
Figure 6:
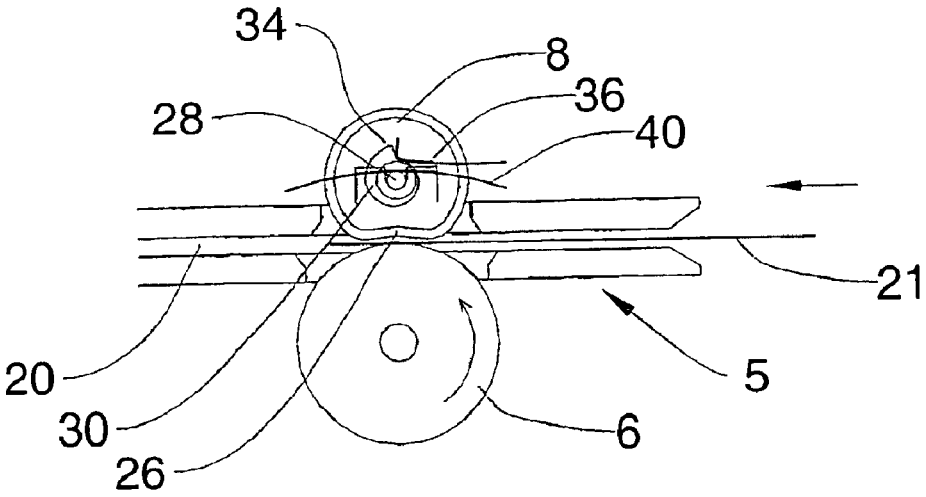
FIG. 6 is a side view of the directionally varying drive roller arrangement.

FIG. 4 shows banknote 21 being driven into the validator 2. In this case the centre leading drive wheel 6*a* is actively driving the banknote 21 due to the gripping of the banknote between the roller 6*a* and a passive cylindrical roller 8*a* associated therewith. In contrast, the two outside leading rollers 6 are each driven in a manner similar to roller 6*a*, however, the passive roller 8 associated therewith as shown in FIG. 6 is not cylindrical and is being held against a clockwise rotation. There is a gap provided between the roller 6 and its associated passive roller 8 and the banknote can slide therebetween. This gap, preferrably about 1 mm, allows pivotting of the banknote during the feed of the banknote into the validator to allow alignment of the banknote as some sliding of the banknote between the rollers 6 and 8 is allowed as a banknote is normally about 0.1 to 0.2 mm thick. As the banknote reaches the secondary drive rollers 12 it is then pulled through the banknote channel as alignment of the banknote with the channel has occurred. Thus the notched roller 8 is held against rotation in one direction and provides a gap such that pivotting of the banknote to provide better alignment continues during infeed of the banknote.

Figure 5:
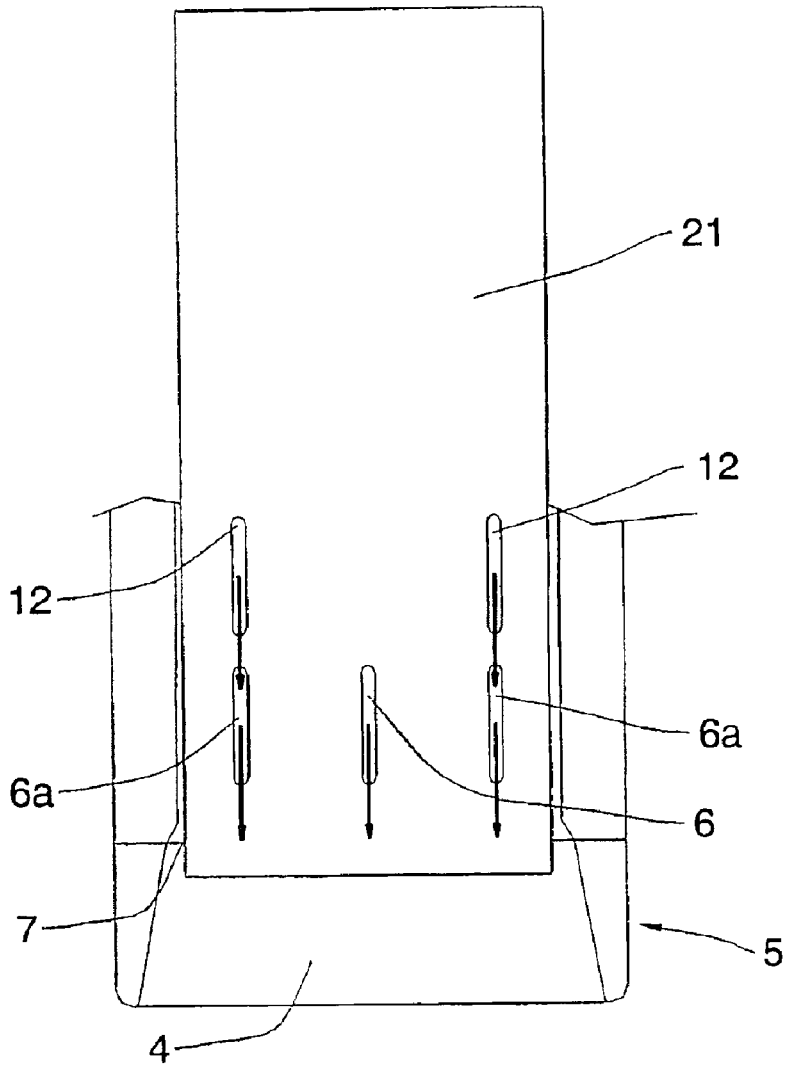
FIG. 5 shows the banknote drive system driven to eject a banknote from the validator.

FIG. 5 shows a banknote 21 being ejected out of the validator. In this case, both the secondary drive rollers 12, the center lead drive roller 6*a* and the two outside lead rollers 6 are all active and drive the banknote 21 through the inlet 4. The banknote does not become jammed as all drive wheels are active and the banknote is positively forced out of the validator. Passive rollers 8*a* are also rotating.

It has been found that the passive rollers 8 rotate during ejection of the banknote even though there is some theoretical clearance between the banknote and the passive roller. It is believed the banknote drags on the passive roller and displaces the notched region and the clearance is then eliminated. Any initial jamming of the banknote at the passive roller 8 would also eliminate the gap and cause a rotation of the passive roller.

FIG. 6 shows a sectional view through one of the outside lead drive rollers 6 and its associated passive roller 8. As can be seen, the passive roller 8 is not circular in cross section and has a flattened or notched portion 26 which defines a gap between drive roller 6 and this flattened portion 26. As can be seen, the banknote 21 can pass through this gap. Typically, there is a light gripping of the banknote and there is a slight frictional drag as the banknote passes the passive roller 8.

The roller 8 rotates about axis 28 and has associated therewith the spiral cam surface 30. This cam surface has a thin leading edge 32 and a stop face 34. A stop spring 36 is associated with the cam surface 30. Rotation of the drive wheel 6 in the counterclockwise direction as shown in FIG. 6, moves the banknote 21 through the gap and past a stationary passive one way roller 8. The roller 8 is held in this position as stop face 34 is in engagement with the end of the spring latch 36. Therefore although the roller 8 would like to rotate in clockwise direction it is stopped against rotation due to engagement of surface 34 with the end of the spring lever 36. This arrangement is duplicated either side of the center lead roller 6*a*. During movement of the banknote into the validator drive rollers 6*a* rotate in the same manner as the center drive roller 6*a*, however, the passive one way rollers 8 are locked in the position shown in FIG. 6 and the banknote slides past the stationary rollers 8. Preferrably drive rollers 6 and 6*a* have a common drive shaft. Thus rollers 6 act to move a banknote through the gap with the associated passive roller 8 held in a stationary position during infeed of the banknote. This gap allows centering during infeed of the banknote to continue.

Figure 7:
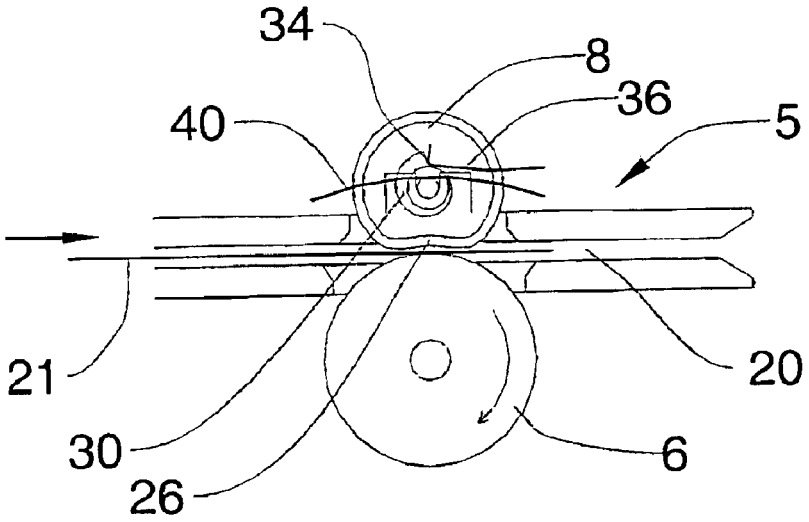
FIG. 7 is a side view of the drive arrangement similar to FIG. 6 with a banknote drawn into the validator with the drive arrangement now initiating ejection of the banknote.
Figure 8:
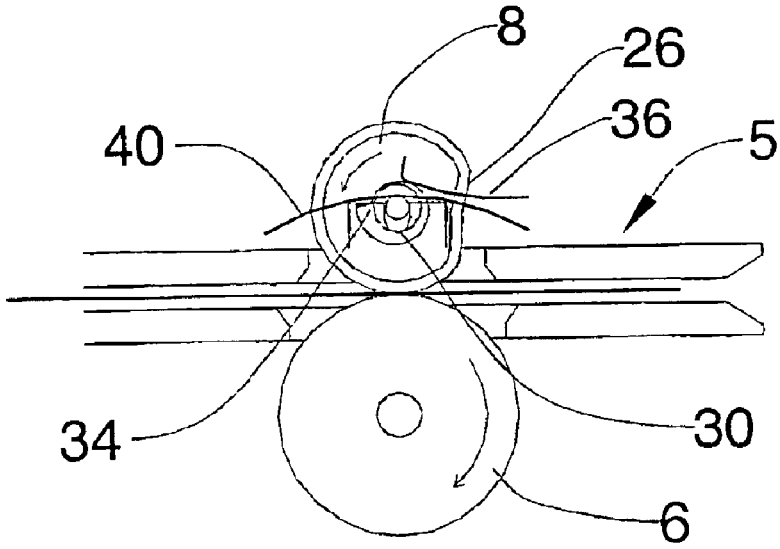
FIG. 8 shows further movement of the drive wheels ejecting the banknote from the validator.

FIG. 7 shows the position of the roller 6 and the one way passive roller 8 as the drive initially starts to rotate to eject the banknote 21 from the banknote channel 20. Roller 6 is rotated in a clockwise direction and the banknote 21 provides a drag force on passive roller 8 encouraging the passive roller 8 to rotate in a counter clockwise direction. This will cause the notched flattened portion 26 to be displaced and passive roller 8 positively engages the banknote and the drive roller 6. This action is shown in FIG. 8 and the cam 30 is rotating with the roller 8 and has caused a slight upward movement of the spring arm 36. As can be appreciated the passive roller 8 can continue to rotate and will continue to rotate as the banknote is ejected from the validator. This requires several rotations of the passive roller 8 and this action continues even when the flattened portion 26 aligns with the drive roller 6. The passive roller 8 is biased by the spring member 40 towards the drive roller 6 and typically there is frictional engagement of the banknote between roller 6 and roller 8 in essentially all positions. Note that initial movement of roller 8 does not require any displacement of the spring arm as the cam has not yet engaged the spring arm. As shown the cam occupies about 180° of the shaft of the roller 8 and the cam strikes the spring arm when the roller is positively driven by the banknote and drive roller 6.

It is also possible although less desirable to increase the gap between the drive rollers 6 and the passive rollers 8 such that rotation of rollers 8 occurs if a banknote starts to jam immediately in front of rollers 8. The jamming of the banknote will cause the gap to fill and rollers 6 and 8 will rotate and clear the jam. Once roller 8 starts to rotate it typically continues to rotate until the banknote is fully ejected.

With the present arrangement the desirable infeed drive characteristics are achieved as shifting of a banknote to allow alignment is accomplished and a banknote does not jam as the drive wheels of the specialized outside inlet drive rollers continue to rotate and move the banknote past the locked passive rollers 8. During ejection of the banknote all drive rollers function and positively move the banknote out the inlet. This drive arrangement has proven to be extremely effective in reducing the occurrence of jammed banknotes during ejection of the banknote from the validator.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A banknote drive system (3) for driving a banknote in a feed direction or in an eject direction, said drive system comprising a banknote inlet (4) for receiving a leading edge of a banknote (21) and guiding the banknote (21) to a series of drive rollers located in a banknote guide channel, said series of drive rollers **(6, 6*a*, 12) being divided between active rollers (6*a*, 12) which drive a banknote in said feed direction and said eject direction and one way drive rollers (6), each of said drive rollers having an associated passive roller (8, 14) positioned such that a banknote driven by said banknote drive system passes between each drive roller (6, 6*a*, 12) and the respective passive roller (8, 14), each one way drive roller (6) cooperating with the respective passive roller (8)** which is held against rotation during movement of a banknote in said feed direction and which is free to rotate and drive a banknote during movement of a banknote in said eject direction opposite to the feed direction.

2. A banknote drive system (3) as claimed in claim 1 wherein each passive roller (8) associated with a one way drive roller (6) includes a one way clutch arrangement (34, 36) which stops rotation of said passive roller (8) when engaged by a banknote (21) during the feed of the banknote into the validator.

3. A banknote drive system (3) as claimed in claim 2 wherein each passive roller (8) associated with a one way roller (6) includes a notched region which provides a clearance between the passive roller and the associated one way driver roller (6) and said one way clutch arrangement stops said passive roller (8) in a position to provide said clearance.

4. A banknote drive system as claimed in claim 1 wherein each passive roller (8) associated with a one way drive roller (6) includes a spiral cam (30) rotatable with said passive roller (8) which cooperates with a stop lever (36), said stop lever (36) cooperating with said spiral cam (30) to stop rotation of said passive roller (8) during feed of a banknote between the one way drive roller (6) and the passive roller (8) and to allow rotation of the passive roller (8) during movement of a banknote (21) in said eject direction.

5. A banknote drive system (3) as claimed in claim 1 wherein said active rollers **(6*a*, 12) have a lead active roller (6*a*) and two following active rollers (12) laid out in a generally triangular configuration and said one way drive rollers (6) are located on opposite sides of said lead active roller (6*a*) and in front of said two following active rollers (12)**.

6. A banknote drive system as claimed in claim 1 wherein said active rollers **(6*a*, 12) and said one way drive rollers (6)** are driven by a common drive train in both the feed direction and the eject direction.

7. A banknote drive system (3) as claimed in claim 1 wherein each passive roller (8) associated with a one way drive roller (6) during movement of a banknote in the eject direction assumes a clear position relative to the one way drive roller (6) allowing a banknote (21) to pass therebetween.

8. A banknote drive system (3) as claimed in claim 1 wherein said active drive rollers **(6*a*, 12) include a lead active drive roller (6*a*) and two following active drive rollers (12) placed either side and behind said lead active drive roller (6*a*)**.

9. A banknote drive system (3) as claimed in claim 2 wherein each one way drive roller (6) forms a gap with its respective passive roller (8) during driving of a banknote in said feed direction such that a banknote slides through said gap, and each one drive roller (6) and the respective passive roller (8) positively engage and drive a banknote (21) during movement of a banknote (21) in said eject direction.

10. A banknote drive system (3) comprising a triangular layout of active drive wheels **(6*a*, 12) which are driven in synchronization in a forward and a reverse direction and drive a banknote (21) through or out of a banknote evaluation channel (20), said active drive wheels (6*a*, 12) including a lead active drive wheel (6*a*) and two following drive wheels (12) placed either side and behind said lead drive wheel (6*a*), said drive system further including two reverse drive assemblies (6, 8) which each define a gap through which a banknote slides past a stationary roller (8) during the feed of a banknote and each reverse drive assembly (6, 8) positively engages and drives a banknote (21) during movement of a banknote (21)** in said reverse direction.

* * * * *